US008499731B2

(12) United States Patent
Burkard et al.

(10) Patent No.: US 8,499,731 B2
(45) Date of Patent: Aug. 6, 2013

(54) CENTRAL VALVE OF A CAMSHAFT ADJUSTER OF AN INTERNAL COMBUSTION ENGINE

(75) Inventors: Hubert Burkard, Hirschaid (DE); Alexander Baecker, Graefenberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 357 days.

(21) Appl. No.: 12/893,047

(22) Filed: Sep. 29, 2010

(65) Prior Publication Data

US 2011/0079189 A1 Apr. 7, 2011

(30) Foreign Application Priority Data

Sep. 30, 2009 (DE) ..... 10 2009 043 777

(51) Int. Cl.
*F01L 1/34* (2006.01)

(52) U.S. Cl.
USPC ..... 123/90.15; 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 8,146,549 | B2 * | 4/2012 | Hoppe et al. | 123/90.17 |
| 2006/0207537 | A1 * | 9/2006 | Nakajima et al. | 123/90.17 |
| 2008/0236529 | A1 * | 10/2008 | Scheidig et al. | 123/90.17 |
| 2008/0271689 | A1 * | 11/2008 | Konias et al. | 123/90.17 |
| 2009/0272350 | A1 * | 11/2009 | Kleiber et al. | 123/90.17 |
| 2012/0055427 | A1 * | 3/2012 | Chen et al. | 123/90.15 |

FOREIGN PATENT DOCUMENTS

WO WO 2009071457 A2 * 6/2009

* cited by examiner

*Primary Examiner* — Thomas Denion
*Assistant Examiner* — Steven D Shipe
(74) *Attorney, Agent, or Firm* — Lucas & Mercanti, LLP

(57) ABSTRACT

A central valve of a camshaft adjuster of an internal combustion engine, which has a valve housing, a control piston and a fastening flange. The valve housing is at least partially arranged within a receptacle within the camshaft adjuster and has hydraulic connections. The control piston bears at least in regions against an inner circumferential surface of the valve housing and is mounted displaceably on the inner circumferential surface. The fastening flange is fixedly connected to a wall of the receptacle and defines the axial position of the valve housing relative to the camshaft adjuster.

7 Claims, 2 Drawing Sheets

Stand der Technik

Stand der Technik

Stand der Technik

CENTRAL VALVE OF A CAMSHAFT ADJUSTER OF AN INTERNAL COMBUSTION ENGINE

This application claims the priority of DE 10 2009 043 777.0 filed Sep. 30, 2009, which is incorporated by reference herein.

FIELD OF THE INVENTION

The invention relates to a central valve of a camshaft adjuster of an internal combustion engine, with a valve housing, a control piston and a fastening flange, wherein the valve housing is at least partially arranged within a receptacle within the camshaft adjuster and has hydraulic connections, wherein the control piston bears at least in regions against an inner circumferential surface of the valve housing and is mounted displaceably on said inner circumferential surface, wherein the fastening flange is fixedly connected to a wall of the receptacle and defines the axial position of the valve housing relative to the camshaft adjuster.

BACKGROUND OF THE INVENTION

In modern internal combustion engines, camshaft adjusters are used in order to be able to variably configure the phase relationship between the crankshaft and camshaft in a defined angle range, between a maximum early position and a maximum late position. For this purpose, the camshaft adjuster is integrated into a drive train via which torque is transmitted to the camshaft by the crankshaft. Said drive train may be realized, for example, as a belt drive, chain drive or gearwheel drive. Camshaft adjusters of this type are generally designed as hydraulic oscillating motors, for example of vane cell design, with at least two pressure chambers acting in an opposed manner. The supply of pressure medium to or the removal of pressure medium from the pressure chambers is controlled by means of a hydraulic directional control valve, for example a proportional valve. Embodiments are known in this connection, in which the hydraulic directional control valve is arranged in a central passage opening of the camshaft adjuster and rotates together therewith. Directional control valves of this type are customarily referred to as central valves.

A central valve of this type is known, for example, from DE 10 2004 038 160 A1. In this embodiment, a camshaft of hollow design reaches through a central passage opening of the camshaft adjuster. Within the camshaft, the central valve is arranged in the region of the camshaft adjuster. The central valve consists of a valve housing, a control piston, a spring element and a snap ring. The valve housing, which is of substantially hollow-cylindrical design, has an inlet connection, an outlet connection and two working connections on the outer circumferential surface thereof. Furthermore, an axial outlet connection is provided. The inlet connection communicates with a pressure medium pump of the internal combustion engine, the outlet connections communicate with a pressure medium reservoir of the internal combustion engine, and the working connections each communicate with a group of pressure chambers of the camshaft adjuster. The control piston is arranged in an axially displaceable manner within the valve housing. In this case, the control piston is displaced into any position between two end stops and held there by means of an electromagnetic adjusting unit counter to the force of the spring element supported on the control piston and the valve housing. The first end stop is implemented by way of the snap ring which is arranged at the open end of the valve housing. The second end stop is implemented by way of the spring receptacle.

Depending on the position of the control piston relative to the valve housing, the volumetric flow of pressure medium fed by the pressure medium pump to the inlet connection is conducted to the first or second working connection and therefore to the first or the second pressure chambers. At the same time, the pressure medium is ejected from the other pressure chambers via the other working connection and one of the outlet connections into the pressure medium reservoir.

In addition to the hydraulic connections, the valve housing has a fastening section, a threaded section in the embodiment illustrated, by means of which the central valve is fixed within the camshaft. Furthermore, a collar which extends in the radial direction, protrudes over the camshaft in the radial direction and bears in the axial direction against a cylinder head of the internal combustion engine is formed on that section of the valve housing which projects out of the camshaft. The collar therefore constitutes part of the axial bearing of the camshaft relative to the cylinder head.

Via the axial bearing and the fastening section, a high amount of force is admitted to the valve housing which has to be of appropriately stable design. The valve housing is customarily produced from a metal blank by means of machining production processes.

Object of the Invention

The invention is based on the object of providing a central valve of a camshaft adjuster of an internal combustion engine, wherein the outlay on production of said central valve is intended to be reduced.

Achievement of the Object

The object is achieved according to the invention in that the fastening flange is composed of a metallic material and the valve housing is composed exclusively of a plastic, the fastening flange being connected to the valve housing.

The central valve has at least a valve housing, a control piston and a fastening flange. The valve housing is at least partially arranged within a receptacle within the camshaft adjuster, for example within a central passage opening of the camshaft adjuster. The valve housing, which may be, for example, of substantially hollow-cylindrical design, has a plurality of hydraulic connections, for example an inlet connection, at least one outlet connection and at least one working connection, wherein the valve housing bears against the wall of the receptacle such that the connections are hydraulically separated from one another outside the valve housing.

The receptacle is located in the region over which the camshaft adjuster engages, and can be formed directly on the camshaft adjuster or on an intermediate component arranged between the camshaft adjuster and the valve housing. For example, a camshaft can reached through the camshaft adjuster, the camshaft having, in the region of the camshaft adjuster, a receptacle in which the valve housing is arranged.

The control piston is accommodated in an axially displaceable manner within the valve housing, wherein said control piston is mounted in an axially displaceable manner on an inner circumferential surface of the valve housing. The control piston may be positioned, for example by means of an electromagnetic adjusting unit, between two end positions. Depending on the position of the control piston relative to the valve housing, pressure medium supplied to the central valve is conducted either to the first or to the second pressure chambers of the camshaft adjuster, with pressure medium being conducted at the same time out of the other pressure chambers to a pressure medium reservoir.

The axial position of the valve housing within the receptacle is defined by means of the fastening flange which is connected to a wall of the receptacle in a rotationally fixed manner and such that it is not displaceable in the axial direction. The fastening flange can be connected fixedly to the wall of the receptacle in a form-fitting, adhesively bonded or frictional manner, for example by means of a welded, soldered, adhesive or screw connection, by means of a press fit or calking.

By means of the formation of the fastening flange as a metallic component, for example from steel, that region of the central valve which is loaded during the operation of the internal combustion engine is separated from the valve housing which is otherwise unloaded and serves merely to control the streams of pressure medium to and from the camshaft adjuster. Only the mechanically loaded fastening flange therefore has to be of solid design while the valve housing can be produced from plastic by means of cost-effective processes.

The valve housing may be fastened to the fastening flange in a form-fitting manner or by means of a clip connection. It is also conceivable for the valve housing to be injection molded directly onto the fastening flange by means of an injection molding process.

The separation of the fastening flange from the valve housing reduces the complexity of the fastening flange which is to be of solid design, and therefore the latter can be produced by means of simpler manufacturing processes than the valve housing known from the prior art. For example, extrusion processes or the like are conceivable. The production of the central valve, in particular of the valve housing and of the fastening component, is therefore considerably simplified and the production costs thereof reduced. Furthermore, the use of material is reduced.

The valve housing is composed of a plastic, for example a thermosetting plastic, and is fixedly connected to the fastening flange. A preferred production variant consists in producing the valve housing in an injection molding process. In this case, for example, the fastening flange can be placed into the injection molding die and the valve housing can be subsequently injection molded onto the fastening flange. The valve housing can therefore be fastened to the fastening flange in a form-fitting manner during the production process.

The production costs and the weight of the central valve are further reduced by the valve housing being formed as a plastics component.

In one development of the invention, provision is made for the control piston to be composed of a plastic, advantageously of the same plastic as the valve housing.

In an advantageous manner, at least one form-fitting element for fastening the valve housing to the fastening flange is formed on the valve housing.

In one development of the invention, provision can be made for the fastening flange to have a collar which is arranged outside the camshaft adjuster and in at least one axial direction bears against a cylinder-head-mounted component of the internal combustion engine. The cylinder-head-mounted component may be, for example, the cylinder head, the cylinder head cover or a component connected fixedly to the cylinder head. Therefore, the axial bearing function of the camshaft or of the camshaft adjuster can be integrated into the central valve according to the invention.

In an advantageous manner, an end stop for the control piston and/or a spring receptacle for a spring element, which is supported on the control piston and the spring receptacle, are/is formed on the valve housing. The additional functionalities can be formed on the valve housing without additional cost during the production thereof, and therefore no further components are required.

BRIEF DESCRIPTION OF THE DRAWINGS

Further features of the invention emerge from the description below and from the drawings in which an exemplary embodiment of the invention is illustrated in simplified form and in which.

DETAILED DESCRIPTION OF THE DRAWINGS

Figure 1:
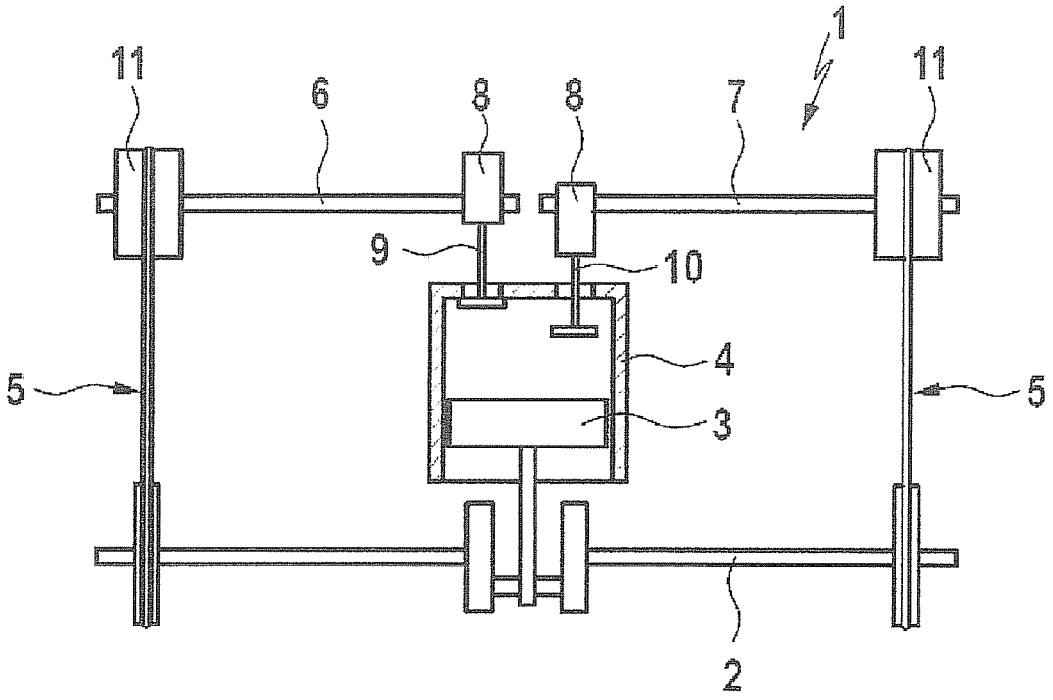
FIG. 1 shows an internal combustion engine merely highly schematically.

FIG. 1 is a sketch of an internal combustion engine in which a piston 3 sitting on a crankshaft 2 is indicated in a cylinder 4. In the embodiment illustrated, the crankshaft 2 is connected to an inlet camshaft 6 and an outlet camshaft 7 via a respective traction mechanism drive 5, wherein a first and a second camshaft adjuster 11 can ensure a relative rotation between the crankshaft 2 and the camshafts 6, 7. Cams 8 of the camshafts 6, 7 actuate one or more inlet gas exchange valves 9 and one or more outlet gas exchange valves 10. Provision may also be made for only one of the camshafts 6, 7 to be equipped with a camshaft adjuster 11 or for there only to be one camshaft 6, 7 which is provided with a camshaft adjuster 11.

Figure 4:
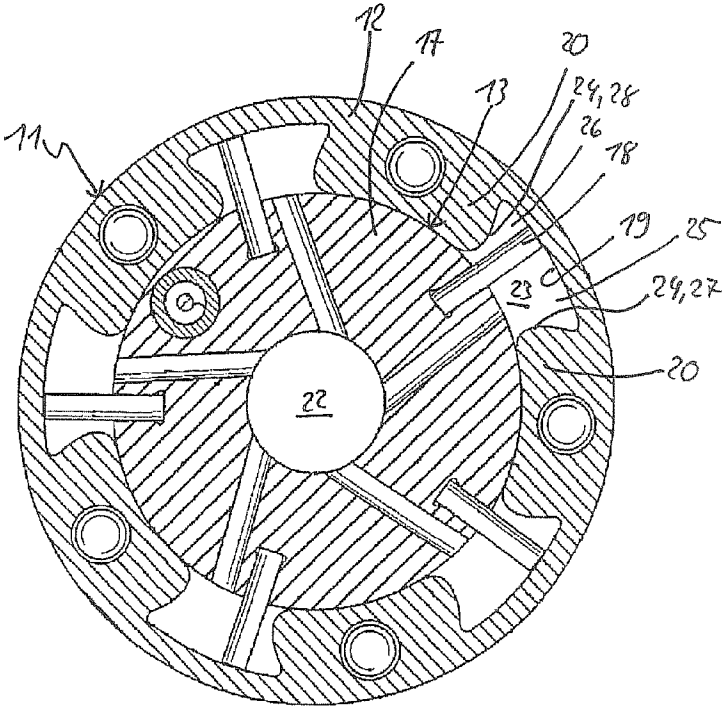
FIG. 4 shows a cross section through the camshaft adjuster from FIG. 3 along the line IV-IV.
Figure 3:
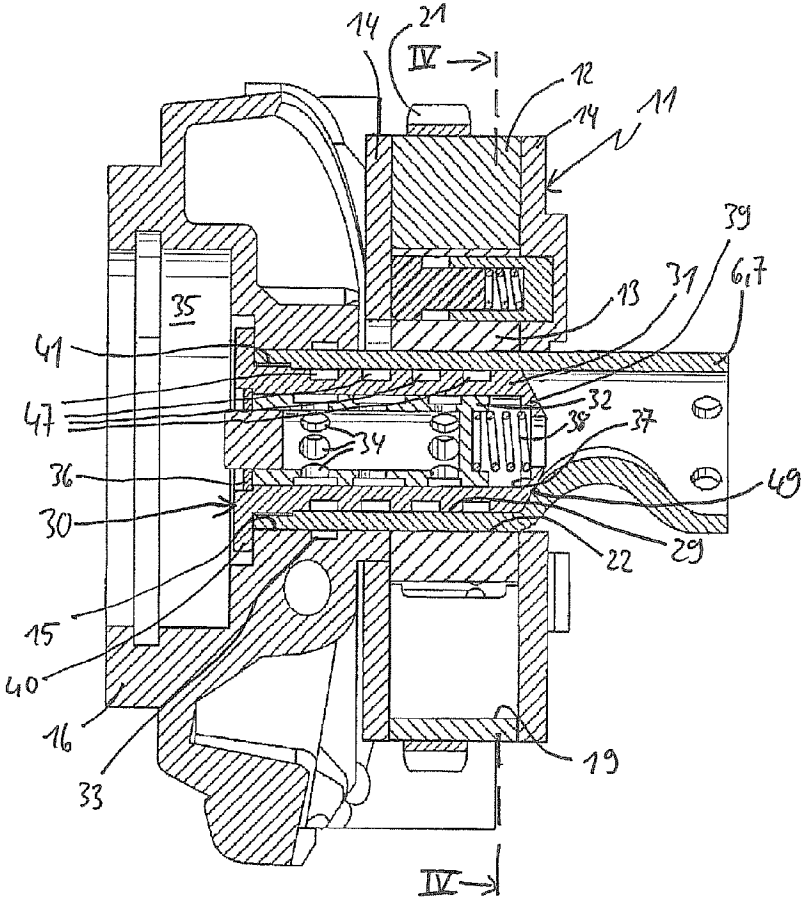
FIG. 3 shows a longitudinal section through a camshaft adjuster fastened to a camshaft and having a central valve according to the prior art.

FIG. 3 shows, in longitudinal section, a camshaft adjuster 11 fastened to a camshaft 6, 7, as disclosed in DE 10 2004 038 160 A1. FIG. 4 shows a cross section through the camshaft adjuster 11 along the line IV-IV in FIG. 3. The camshaft adjuster 11 has a driving element 12 and a driven element 13. A respective side cover 14 is arranged on the axial side surfaces of the driving element 12. The side covers 14 are connected in a rotationally fixed manner to the driving element 12. Five projections 20 extend radially inward from a circumferential wall 19 of the driving element 12. In the embodiment illustrated, the projections 20 are formed as a single part with the circumferential wall 19. By means of radially inner circumferential walls of the projections 20 relative to the driven element 13, the driving element 12 is arranged rotatably with respect to the latter.

The driven element 13 is in the form of an impeller and has a hub element 17 which is of substantially cylindrical design and from the outer, cylindrical circumferential surface of which, in the embodiment illustrated, five vanes 18 extend outward in the radial direction. The vanes 18 are formed separately from the driven element 13 and are arranged in vane grooves in the outer circumferential surface of the hub element 17.

Torque can be transmitted by the crankshaft 2 to the driving element 12 by means of a chain drive (not illustrated) via a chain wheel 21 which is connected in a rotationally fixed manner to the driving element 12. The camshaft 6, 7 reaches through a central passage opening 22 of the driven element 13, said camshaft being connected to the driven element 13 in a frictional manner. In the embodiment illustrated, the camshaft 6, 7 is designed as a hollow shaft and is mounted rotatably within a camshaft radial bearing 15 of a cylinder head 16.

Within the camshaft adjuster 11, a pressure space 23 is formed between every two adjacent projections 20 in the circumferential direction. Each of the pressure spaces 23 is delimited in the circumferential direction by opposite, substantially radially extending boundary walls 24 of adjacent projections 20, in the axial direction by the side covers 14, radially inward by the hub element 17 and radially outward by the circumferential wall 19. A vane 18 projects into each of the pressure spaces 23, wherein the vanes 18 are designed in such a manner that they bear both against the side covers 14 and against the circumferential wall 19. Each vane 18 therefore divides the particular pressure space 23 into two pressure chambers 25, 26 acting in an opposed manner.

The driven element 13 is arranged rotatably in a defined angle range with respect to the driving element 12. The angle range is delimited in one direction of rotation of the driven element 13 by the vanes 18 coming to bear in each case against a corresponding boundary wall 24 (early stop 27) of the pressure spaces 23. The angle range in the other direction of rotation is analogously bounded by the vanes 18 coming to bear against the other boundary walls 24 of the pressure spaces 23, which boundary walls serve as a late stop 28.

The phase position of the driving element 12 with respect to the driven element 13 (and therefore the phase position of the camshaft 6, 7 with respect to the crankshaft 2) can be varied by pressurization of one group of pressure chambers 25, 26 and pressure relief of the other group. The phase position can be kept constant by pressurization of both groups of pressure chambers 25, 26.

A central valve 30 is arranged in a receptacle 29 of the camshaft 6, 7. The central valve 30 has a valve housing 31 and a control piston 32. The valve housing 31 is of substantially hollow-cylindrical design, wherein an inlet connection P, an outlet connection T and two working connections A, B in the form of annular grooves 47 communicating with the interior of the valve housing 31 by means of a radial openings 48 are formed on the cylindrical circumferential surface of said valve housing. Furthermore, an axial outlet connection T, in the form of an axial opening, is provided.

The inlet connection P communicates with a pressure medium pump (not illustrated) via a pressure medium channel 33 formed in the cylinder head 16. The outlet connections T communicate with a pressure medium reservoir (likewise not illustrated). The first working connection A communicates with the first pressure chambers 25, and the second working connection B communicates with the second pressure chambers 26.

During the operation of the internal combustion engine 1, pressure medium passes via the inlet connection P into the interior of the valve housing 31 and via piston openings 34 into the interior of the control piston 32. Depending on the position of the control piston 32 relative to the valve housing 31, the pressure medium passes to the first or second working connection A, B and therefore to the respective pressure chambers 25, 26. At the same time, pressure medium is conducted from the other pressure chambers 25, 26 via the other working connections A, B and the respective outlet connection T to the pressure medium reservoir.

The axial position of the control piston 32 can be set as desired between two end stops 36, 37 by means of an electromagnetic adjusting unit 35. The first end stop 36 is realized by means of a snap ring which is arranged on the open side of the valve housing 31. In this case, the control piston 32 is acted upon on one side by a push rod (not illustrated) of the adjusting unit 35 and on the other side by a spring element 39 which is supported on a spring receptacle 39 of the valve housing 31, which spring receptacle at the same time forms the second end stop 37.

The valve housing 31 is fastened in a rotationally fixed and nondisplaceable manner in the camshaft 6, 7. For this purpose, a threaded section 41 is formed on the valve housing 31 and is used to screw the latter to the camshaft 6, 7. The valve housing 31, at the end thereof which protrudes out of the camshaft 6, 7, has a collar 40 extending in the radial direction. The collar 40 bears in the axial direction against the cylinder head 16 such that an axial movement of the camshaft 6, 7 to the right in FIG. 3 is prevented. Furthermore, the drive element 13 likewise bears against the cylinder head 16 such that an axial movement of the camshaft 6, 7 to the left in FIG. 3 is prevented. The collar 40 therefore forms part of the axial bearing of the camshaft 6, 7 in the cylinder head 16.

In this embodiment which is known from the prior art, the valve housing 31 takes over the function of distributing pressure medium to the pressure chambers 25, 26 and the axial bearing of the camshaft 6, 7. Furthermore, the fastening of the central valve 30 within the receptacle 29 is likewise carried out via the valve housing 31. The valve housing 31 has to be formed with increased strength because of the axial bearing and fastening function. The valve housing 31 is customarily produced from a solid metal blank by machining, for example by turning. During the production of the valve housing 31, a large amount of material has to be removed from the blank because of the collar 40 and the threaded section 41, thus resulting in high material costs and in the cycle times being low.

Figure 2:
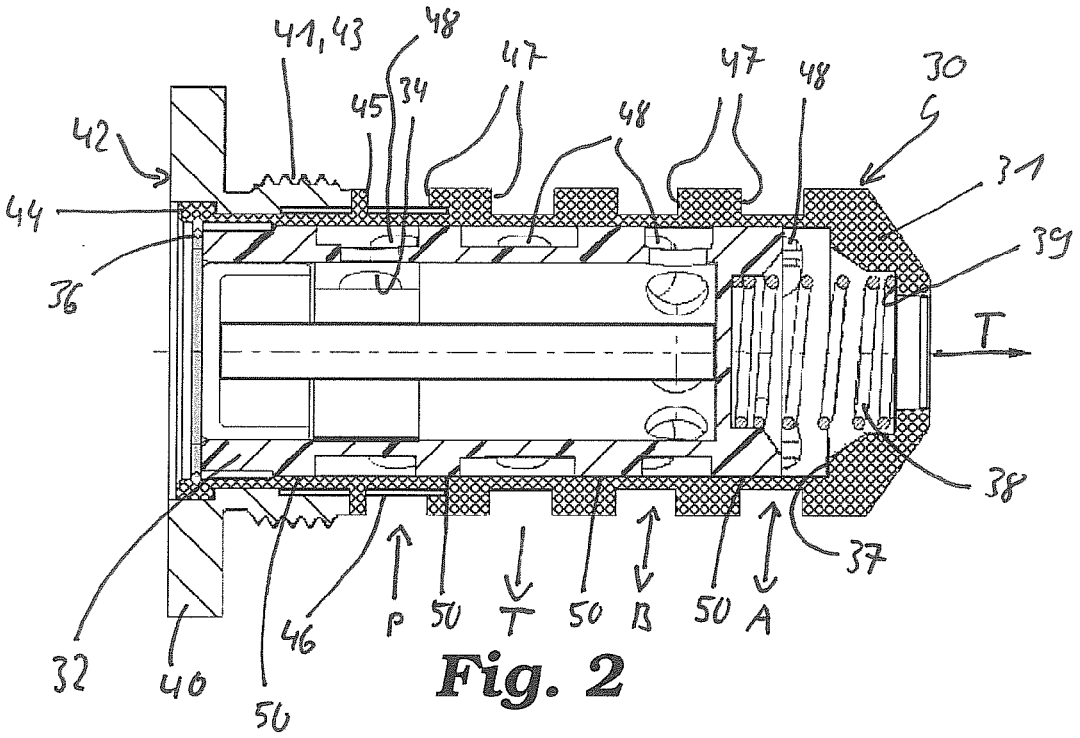
FIG. 2 shows a longitudinal section through a central valve according to the invention.

FIG. 2 shows by way of example an embodiment of a central valve 30 according to the invention which does not have these disadvantages. In contrast to the central valve 30 known from the prior art, the axial bearing and fastening functionalities are separated from the valve housing 31 and integrated into a fastening flange 42.

Therefore, only the fastening flange 42 has to be of high strength and formed as a metal component, for example a steel component. Owing to the low complexity of the fastening flange, turned components, for example, are conceivable, but so too are sintered parts, metal injection-molded parts, deep drawn parts or extruded parts which, if appropriate, are finished by machining. The fastening flange 42 has the collar 40 required for the axial bearing of the camshaft 6, 7 and a fastening section 43. The fixed connection between the camshaft 6, 7 and the central valve 30 is produced by means of the fastening section 43. In the embodiment illustrated, a threaded section 41 is formed on the fastening section 43. Form-fitting elements or a surface, by means of which a press fit to the camshaft 6, 7 can be realized, are likewise conceivable.

Since, in this embodiment, only low mechanical loads act on the valve housing 31, the latter can be designed as a cost-effective plastics component, for example composed of a thermosetting plastics material. The material use and the production time for producing the central valve 30 are therefore considerably reduced.

Four annular grooves 47 which are offset axially with respect to one another and in the groove basis of which openings 48 are provided are formed on the outer circumferential surface of the valve housing 31. Pressure medium can be interchanged between the interior and the exterior of the valve housing 31 via the annular grooves 47 and the openings 48, which form the radial pressure medium connections A, B, P, T.

In the embodiment illustrated, the valve housing 31 reaches through the fastening flange 42, with the two components being connected in a form-fitting manner. For this purpose, a first and a plurality of second radially extending projections 44, 45 are formed on the valve housing 31. The first projection 44 is of annular design and bears against a step of the fastening flange 42. The second projections 45 bear against an axial side surface of the fastening flange 42.

In the region of the inlet connection P, the valve housing 31 receives a filter element 46 which, in the embodiment illustrated, is designed as an annular filter and prevents dirt particles from entering the valve housing 31.

The control piston 32, which is likewise composed of a thermosetting plastic, and the spring element 38 are arranged within the valve housing 31. The control piston 32 is arranged in an axially displaceable manner between a first end stop 36, which is implemented by way of a retaining ring engaging in an annular groove of the valve housing 31, and the second end stop 37, which is formed by the spring receptacle 39. The control piston 32 has a plurality of control sections 50 which are separated in the axial direction from regions of smaller diameter. In this case, the outer diameters of the control sections 50 are matched to the inner diameter of the valve housing 31, and therefore the inner circumferential surface of the valve housing 31 serves as a bearing surface for the control piston 32. The spring element 38 is supported on one side or the spring bearing 39 and on the other side on the control piston 32.

The central valve is produced, for example, by means of an injection molding process. The premanufactured fastening flange 42 and the filter element 46 are placed into an injection molding die. The plastics valve housing is then formed, with it being possible at the same time for the form-fitting connections between the valve housing 31, on the one hand, and the fastening flange 42 and the filter element 46, on the other hand, to be produced. The spring element 38 and the control piston 32 are subsequently positioned within the valve housing 31 and the retaining ring fitted. To install the central valve 30 in the receptacle 29, said central valve is screwed by means of the threaded section 41 into the camshaft 6, 7. The valve housing 31 comes into contact in the process with a stop 49 (FIG. 3) which is formed in the camshaft 6, 7.

Furthermore, embodiments in which the central valve 30 is directly connected to the central passage opening 22 of the driven element 13 by means of the fastening section 43, are also conceivable. In this case, the camshaft 6, 7 reaches at least not completely through the central passage opening 22, and the fastening section 43 bears directly against the wall of the central passage opening 22, which wall serves in this case as the receptacle 29.

DESIGNATIONS

1 Internal combustion engine
2 Crankshaft
3 Piston
4 Cylinder
5 Traction mechanism drive
6 Inlet camshaft
7 Outlet camshaft
8 Cam
9 Inlet gas exchange valve
10 Outlet gas exchange valve
11 Camshaft adjuster
12 Driving element
13 Driven element
14 Side cover
15 Camshaft radial bearing
16 Cylinder head
17 Hub element
18 Vane
19 Circumferential wall
20 Projection
21 Chain wheel
22 Central passage opening
23 Pressure space
24 Boundary wall
25 First pressure chamber
26 Second pressure chamber
27 Early stop
28 Late stop
29 Receptacle
30 Central valve
31 Valve housing
32 Control piston
33 Pressure medium channel
34 Piston opening
35 Adjusting unit
36 End stop
37 End stop
38 Spring element
39 Spring receptacle
40 Collar
41 Threaded section
42 Fastening flange
43 Fastening section
44 First projection
45 Second projection
46 Filter element
47 Annular groove
48 Opening
49 Stop
50 Control section
A First working connection
B Second working connection
P Inlet connection
T Outlet connection

The invention claimed is:

1. A central valve of a camshaft adjuster of an internal combustion engine, comprising:

a valve housing; a control piston; and a fastening flange, wherein the valve housing is at least partially arranged within a receptacle within the camshaft adjuster and has hydraulic connections, wherein the control piston bears at least in regions against an inner circumferential surface of the valve housing and is mounted displaceably on said inner circumferential surface, wherein the fastening flange and the valve housing are connected and together form an integral element, and the fastening flange is fixedly connected directly to a wall of the receptacle and defines the axial position of the valve housing relative to the camshaft adjuster, and wherein the fastening flange is composed of a metallic material and the valve housing is composed exclusively of a plastic.

2. The central valve according to claim 1, wherein the control piston is composed of a plastic.

3. The central valve according to claim 1, wherein the valve housing is composed of a thermosetting plastics material.

4. The central valve according to claim 1, wherein the fastening flange has a collar which is arranged outside the camshaft adjuster and in at least one axial direction bears against a cylinder-head-mounted component of the internal combustion engine.

5. The central valve according to claim 1, wherein, on the valve housing, one end stop is designed for the control piston.

6. The central valve according to claim 1, wherein a spring receptacle is formed on the valve housing for a spring element which is supported on the control piston and on the spring receptacle.

7. The central valve according to claim 1, wherein at least one form-fitting element for fastening the valve housing to the fastening flange is formed on the valve housing.

* * * * *